US010796619B2

(12) United States Patent
Bae et al.

(10) Patent No.: US 10,796,619 B2
(45) Date of Patent: Oct. 6, 2020

(54) DISPLAY DEVICE AND DRIVING METHOD THEREOF

(71) Applicant: SAMSUNG DISPLAY CO., LTD., Yongin-si, Gyeonggi-do (KR)

(72) Inventors: Hyeon Seok Bae, Suwon-si (KR); Haeng Won Park, Seongnam-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 148 days.

(21) Appl. No.: 15/868,348

(22) Filed: Jan. 11, 2018

(65) Prior Publication Data

US 2018/0204499 A1 Jul. 19, 2018

(30) Foreign Application Priority Data

Jan. 17, 2017 (KR) ..... 10-2017-0008088

(51) Int. Cl.
*G09G 3/20* (2006.01)
*G09G 3/36* (2006.01)

(52) U.S. Cl.
CPC ..... *G09G 3/2003* (2013.01); *G09G 3/3607* (2013.01); *G09G 3/3648* (2013.01); *G09G 3/3674* (2013.01); *G09G 3/3685* (2013.01); *G09G 3/3688* (2013.01); *G09G 3/3614* (2013.01); *G09G 2300/0426* (2013.01); *G09G 2300/0452* (2013.01);

(Continued)

(58) Field of Classification Search
CPC .. G09G 3/3607; G09G 3/3688; G09G 3/2003; G09G 3/3674; G09G 3/3685; G09G 3/3648; G09G 3/3614; G09G 3/3266; G09G 3/3677; G09G 2300/0426; G09G 2300/0452; G09G 2310/0267; G09G 2310/0286; G09G 2310/027; G09G 2310/0248; G09G 2310/08; G09G 2320/0209; G09G 2320/0666
See application file for complete search history.

(56) References Cited

U.S. PATENT DOCUMENTS 6,327,008 B1 12/2001 Fujiyoshi
2010/0315403 A1* 12/2010 Kaneyoshi ..... G09G 3/3614 345/211

(Continued)

FOREIGN PATENT DOCUMENTS

EP 2597511 A 5/2013
EP 2667376 A1 11/2013

(Continued)

*Primary Examiner* — Jimmy H Nguyen
(74) *Attorney, Agent, or Firm* — Cantor Colburn LLP

(57) ABSTRACT

A display device a includes: a display portion including pixels arranged in a matrix form; gate lines extending in a row direction for each pixel row and connected to the pixels; and a gate driver which applies a gate signal of a gate-on voltage to the plurality of gate lines. The gate driver applies the gate signal in the order of a k-th gate line, a (k+3)-th gate line, a (k+1)-th gate line, a (k+4)-th gate line, a (k+2)-th gate line, and a (k+5)-th gate line, where k is an integer greater than 1, and pixels connected to the k-th gate line and the (k+3)-th gate line display a first color, pixels connected to the (k+1)-th gate line and the (k+4)-th gate line display a second color, and pixels connected to the (k+2)-th gate line and the (k+5)-th gate line display a third color.

20 Claims, 6 Drawing Sheets

(52) U.S. Cl.
CPC ..... *G09G 2310/027* (2013.01); *G09G 2310/0248* (2013.01); *G09G 2310/0267* (2013.01); *G09G 2310/0286* (2013.01); *G09G 2310/08* (2013.01); *G09G 2320/0209* (2013.01); *G09G 2320/0666* (2013.01)

(56) References Cited

U.S. PATENT DOCUMENTS

| | | | | |
|---|---|---|---|---|
| 2012/0293762 | A1* | 11/2012 | Shin ..... | G09G 3/3677 349/139 |
| 2013/0141658 | A1 | 6/2013 | Lv et al. | |
| 2013/0188397 | A1 | 7/2013 | Wu et al. | |
| 2014/0111413 | A1 | 4/2014 | Chen et al. | |

FOREIGN PATENT DOCUMENTS

| | | | |
|---|---|---|---|
| KR | 100202235 | B1 | 3/1999 |
| KR | 100206584 | B1 | 4/1999 |
| KR | 100218375 | B1 | 6/1999 |
| KR | 100210822 | B1 | 7/1999 |
| KR | 1019990059983 | A | 7/1999 |
| KR | 1020010103395 | A | 11/2001 |
| KR | 100483398 | B1 | 4/2005 |
| KR | 100483527 | | 4/2005 |
| KR | 1020060027138 | A | 3/2006 |
| KR | 100729778 | B1 | 6/2007 |
| KR | 100731049 | B1 | 6/2007 |
| KR | 100745406 | B1 | 7/2007 |
| KR | 100764049 | B1 | 9/2007 |
| KR | 100796700 | B1 | 1/2008 |
| KR | 100806562 | B1 | 2/2008 |
| KR | 100830351 | B1 | 5/2008 |
| KR | 100840324 | B1 | 6/2008 |
| KR | 100853720 | B1 | 8/2008 |
| KR | 100998281 | B1 | 11/2010 |
| KR | 101044920 | B1 | 6/2011 |
| KR | 101252572 | B1 | 4/2013 |
| KR | 20130041801 | A | 4/2013 |
| KR | 101286532 | B1 | 7/2013 |
| KR | 20140117596 | A | 10/2014 |
| KR | 1020150035187 | A | 4/2015 |
| KR | 101521732 | B1 | 5/2015 |

* cited by examiner

DISPLAY DEVICE AND DRIVING METHOD THEREOF

This application claims priority to Korean Patent Application No. 10-2017-0008088, filed on Jan. 17, 2017, and all the benefits accruing therefrom under 35 U.S.C. § 119, the content of which in its entirety is herein incorporated by reference.

BACKGROUND

(a) Field

Embodiments of the invention relate to a display device. More particularly, embodiments of the invention relate to a display device with increased charging efficiency of a data voltage, and a driving method thereof.

(b) Description of the Related Art

A display device typically includes a display panel including a plurality of pixels for displaying an image. The plurality of pixels may be arranged in a matrix form and connected to a plurality of gate lines extending in a row direction and a plurality of data lines extending in a column direction. A pixel receives a gate signal applied through a corresponding gate line and a data signal applied through a corresponding data line in synchronization with the gate signal.

As display device technology has advanced, the display device has become large-sized, high-resolution, and high-speed. Accordingly, a gate signal may be desired to be applied to a larger number of gate lines for a predetermined time, and time for inputting a data voltage to pixels is shortened accordingly. Further, time for inputting the data voltage may be more shortened depending on an arrangement structure of the plurality of pixels. As the time for inputting the data voltage is shortened, the data voltage may not be sufficiently charged to the pixels, thereby causing color crosstalk, which causes color deterioration, and a charging-related stain.

SUMMARY

Embodiments of the invention relate to a display device with increased charging efficiency of a data voltage, and a driving method thereof.

An exemplary embodiment of a display device includes: a display portion including a plurality of pixels arranged in a matrix form; a plurality of gate lines extending in a row direction for each pixel row and connected to the plurality of pixels; and a gate driver which applies a gate signal having a gate-on voltage to the plurality of gate lines. In such an embodiment, the gate driver applies the gate signal in the order of a k-th gate line, a (k+3)-th gate line, a (k+1)-th gate line, a (k+4)-th gate line, a (k+2)-th gate line, and a (k+5)-th gate line, where k is an integer greater than 1, and a plurality of pixels connected to the k-th gate line and a plurality of pixels connected to the (k+3)-th gate line display an image with a first color, a plurality of pixels connected to the (k+1)-th gate line and a plurality of pixels connected to the (k+4)-th gate line display an image with a second color, and a plurality of pixels connected to the (k+2)-th gate line and a plurality of pixels connected to the (k+5)-th gate line display an image with a third color.

In an exemplary embodiment, a plurality of pixels in a same pixel row, among the plurality of pixels, may display a same color as each other.

In an exemplary embodiment, the first color, the second color and the third color may be different colors from each other.

In an exemplary embodiment, the gate driver may apply the gate signal in the order of a (k+6)-th gate line, a (k+9)-th gate line, a (k+7)-th gate line, a (k+10)-th gate line, a (k+8)-th gate line, and a (k+11)-th gate line after applying the gate signal to the (k+5)-th gate line.

In an exemplary embodiment, the display device may further include a plurality of data lines connected to the plurality of pixels; and a data driver which applies a plurality of data voltages to the plurality of data lines, where the data driver may apply data voltages of different polarities to data lines at opposite sides of each of a plurality of pixel column.

In an exemplary embodiment, a connection direction between a plurality of pixels in each of the plurality of pixel columns and the data lines at the opposite sides thereof may be changed every three pixel rows.

In an exemplary embodiment, a polarity of a data voltage applied to the plurality of pixels in each of the plurality of pixel columns may be changed every three pixel rows.

In an exemplary embodiment, the data driver may continuously apply a data voltage for the pixels of the first color to the plurality of data lines when the gate signal having the gate-on voltage is applied to the k-th gate line and the (k+3)-th gate line, may continuously apply a data voltage for the pixels of the second color to the plurality of data lines when the gate signal having the gate-on voltage is applied to the (k+1)-th gate line and the (k+4)-th gate line, and may continuously apply a data voltage for the pixels of the third color to the plurality of data lines when the gate signal having the gate-on voltage is applied to the (k+2)-th gate line and the (k+5)-th gate line.

Another exemplary embodiment of a display device includes: a plurality of gate lines connected to a plurality of pixels; and a gate driver which applies a plurality of gate lines to a plurality of pixels by being synchronized by a plurality of clock signals, where the gate driver includes: a first gate driving block which outputs a first gate signal to a first gate line by being synchronized with a first clock signal; a second gate driving block which outputs a second gate signal to a second gate line, which is adjacent to the first gate line, by being synchronized with a second clock signal; a third gate driving block which outputs a third gate signal to a third gate line, which is adjacent to the second gate line, by being synchronized with a third clock signal; a fourth gate driving block which outputs a fourth gate signal to a fourth gate line, which is adjacent to the third gate line, by being synchronized with a fourth clock signal; a fifth gate driving block which outputs a fifth gate signal to a fifth gate line, which is adjacent to the fourth gate line, by being synchronized with a fifth clock signal; and a sixth gate driving block which outputs a sixth gate signal to a sixth gate line, which is adjacent to the fifth gate line, by being synchronized with a sixth clock signal, and the plurality of clock signals having a gate-on voltage is applied to the gate driver in the order of the first clock signal, the fourth clock signal, the second clock signal, the fifth clock signal, the third clock signal, and the sixth clock signal.

In an exemplary embodiment, the gate driver may output the plurality of gate signals having the gate-on voltage in the order of the first gate signal, the fourth gate signal, the second gate signal, the fifth gate signal, the third gate signal, and the sixth gate signal.

In an exemplary embodiment, the display device may further include: a plurality of first pixels connected to one of the first gate line and the fourth gate line; a plurality of second pixels connected to one of the second gate line and the fifth gate line; a plurality of third pixels connected to one of the third gate line and the sixth gate line, where the first pixel, the second pixel, and the third pixel may display different colors from each other.

In an exemplary embodiment, each of the first pixels may be one of a red pixel, a green pixel and a blue pixel, each of the second pixels may be another of the red pixel, the green pixel and the blue pixel, and each of the third pixels may be the other of the red pixel, the green pixel and the blue pixel.

In an exemplary embodiment, the display device may further include: a plurality of data lines connected to the plurality of pixels; and a data driver which applies a plurality of data voltages to the plurality of data lines, where the data driver may continuously apply a data voltage for the first pixels to the plurality of data lines when the first gate signal and the fourth gate signal have the gate-on voltage.

In an exemplary embodiment, the data driver may continuously apply a data voltage for the second pixels to the plurality of data lines when the second gate signal and the fifth gate signal have the gate-on voltage.

In an exemplary embodiment, the data driver may continuously apply a data voltage for the third pixels to the plurality of data lines when the third gate signal and the sixth gate signal have the gate-on voltage.

According to another exemplary embodiment of the invention, a driving method of a display device including a plurality of gate lines and a plurality of data lines, the gate lines extending in a row direction and connected to a plurality of pixels arranged in a matrix form, the plurality of data lines connected to the plurality of pixels, includes: applying a gate signal having a gate-on voltage to the gate lines in the order of a k-th gate line, a (k+3)-th gate line, a (k+1)-th gate line, a (k+4)-th gate line, a (k+2)-th gate line, and a (k+5)-th gate line (where k is an integer greater than 1); and applying a data voltage corresponding to the gate signal to the plurality of data lines, where a plurality of pixels connected to the k-th gate line and a plurality of pixels connected to the (k+3)-th gate line display a first color, a plurality of pixels connected to the (k+1)-th gate line and a plurality of pixels connected to the (k+4)-th gate line display a second color, and a plurality of pixels connected to the (k+2)-th gate line and a plurality of pixels connected to the (k+5)-th gate line display a third color.

In an exemplary embodiment, a plurality of pixels in a same pixel row, among the plurality of pixels, may display a same color as each other.

In an exemplary embodiment, the first color, the second color, and the third color may be different colors from each other.

In an exemplary embodiment, the driving method may further include applying the gate signal to the gate lines in the order of a (k+6)-th gate line, a (k+9)-th gate line, a (k+7)-th gate line, a (k+10)-th gate line, a (k+8)-th gate line, and a (k+11)-th gate line after the applying the gate signal to the (k+5)-th gate line.

In an exemplary embodiment, the applying a data voltage corresponding to the gate signal to the plurality of data lines may include: continuously applying a data voltage for the pixels of the first color to the plurality of data lines when the gate signal is applied to the k-th gate line and the (k+3)-th gate line; continuously applying a data voltage for the pixels of the second color to the plurality of data lines when the gate signal is applied to the (k+1)-th gate line and the (k+4)-th gate line; and continuously applying a data voltage for the pixels of the third color to the plurality of data lines when the gate signal is applied to the (k+2)-th gate line and the (k+5)-th gate line.

In an exemplary embodiment, the display device may continuously apply a data voltage for pixels of a same color to data lines when displaying an image of a solid color so that time for application of the data voltage to the data line may be doubled, and accordingly, charging efficiency of the data voltage input to the pixel may be increased.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
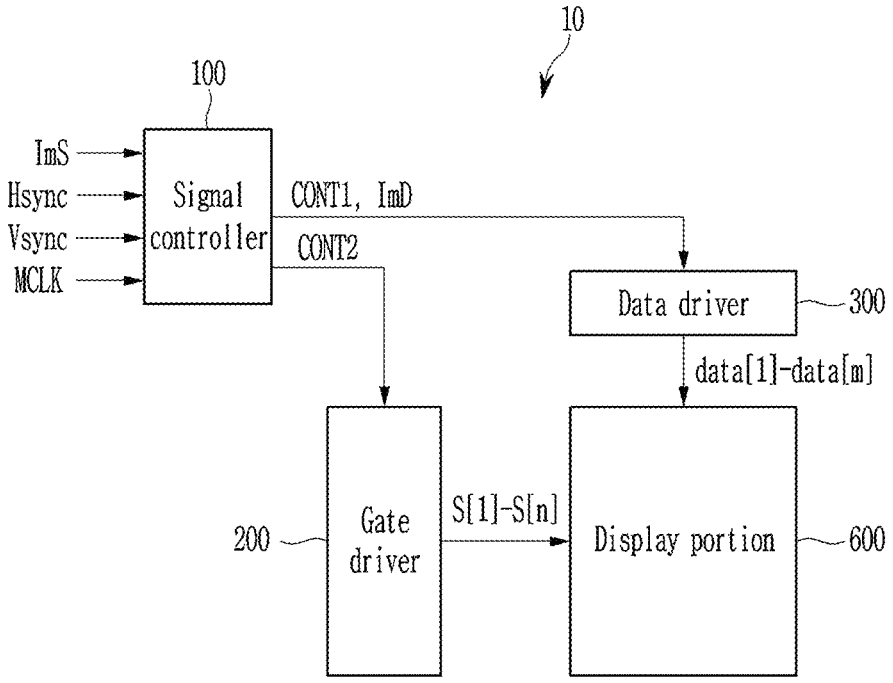
FIG. 1 is a schematic block diagram of a display device according to an exemplary embodiment of the invention.

The invention will be described more fully hereinafter with reference to the accompanying drawings, in which exemplary embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element such as a layer, film, region, or substrate is referred to as being "on" another element, it can be directly on the other element or intervening elements may also be present. In contrast, when an element is referred to as being "directly on" another element, there are no intervening elements present. Further, throughout the specification, the word "on" means positioning on or below the object portion, but does not essentially mean positioning on the upper side of the object portion based on a gravitational direction.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Hereinafter, exemplary embodiments of the invention will be described in detail with reference to the accompanying drawings.

FIG. 1 is a schematic block diagram of a display device according to an exemplary embodiment of the invention.

Referring to FIG. 1, an exemplary embodiment of a display device 10 includes a signal controller 100, a gate driver 200, a data driver 300, and a display portion 600. In an exemplary embodiment, the display device 10 may be a liquid crystal display ("LCD"), and may further include a backlight portion (not shown) that provides light to the display portion 600. However, the display device 10 is not limited thereto. In one alternative exemplary embodiment, for example, the display device 10 may be a light emitting display device including an organic light emitting diode or an inorganic light emitting diode. Hereinafter, for convenience of description, exemplary embodiment, where the display device 10 is an LCD, will be described in detail.

The signal controller 100 receives an image signal ImS and a synchronization signal from an external device. The image signal ImS includes luminance information of a plurality of pixels. Luminance may have a predetermined number of gray levels, for example, 1024 ($=2^{10}$), 256 ($=2^{8}$) or 64 ($=2^{6}$). The synchronization signal includes a horizontal synchronization signal Hsync, a vertical synchronization signal Vsync, and a main clock signal MCLK.

The signal controller 100 generates a first driving control signal CONT1, a second driving control signal CONT2 and an image data signal ImD based on the input image signal ImS, the horizontal synchronization signal Hsync, the vertical synchronization signal Vsync and the main clock signal MCLK.

The signal controller 100 divides the input image signal ImS by frame units based on the vertical synchronization signal Vsync, and divides the input image signal ImS by gate line units based on the horizontal synchronization signal Hsync, to generate the image data signal ImD. The signal controller 100 transmits the image data signal ImD and the first driving control signal CONT1 to the data driver 300. The signal controller 100 transmits the second driving control signal CONT2 to the gate driver 200. The second driving control signal CONT2 may include a plurality of gate start signals, a plurality of clock signals or the like, which will be described later in greater detail.

The display portion 600 has a display area including a plurality of pixels arranged substantially in a matrix form with a plurality of rows and a plurality of columns. In an exemplary embodiment, a plurality of gate lines and a plurality of data lines are disposed in the display portion 600 to be connected to the pixels. In such an embodiment, the gate lines extend substantially in a row direction and are substantially parallel with each other, and the data lines extend substantially in a column direction and are substantially parallel with each other.

Each of the pixels may emit light of a primary color. In one exemplary embodiment, for example, primary colors include red, green and blue, and the three primary colors are spatially or temporally combined to obtain a desired color. A color may be displayed by a red pixel, a green pixel and a blue pixel, and the red pixel, the green pixel and the blue pixel may collectively define, or be collectively referred to as, a unit pixel.

In an exemplary embodiment, the red pixel, the green pixel and the blue pixel are alternately arranged in a same pixel column, and the pixels arranged in a same pixel row display a same color. In such an embodiment, the pixels that are adjacent to each other at intervals of three pixel rows may be pixels that display a same color. A configuration of the display portion 600 will be described later in detail with reference to FIG. 2.

The gate driver 200 is connected to a plurality of gate lines, and generates a plurality of gate signals S[1] to S[n] in response to a second driving control signal CONT2. The gate driver 200 is synchronized with a plurality of clock signals, and applies a plurality of gate signals S[1] to S[n] having a gate-on voltage to the plurality of gate lines, respectively. The gate driver 200 may alternately apply the plurality of gate signals S[1] to S[n] having the gate-on voltage to the plurality of gate lines at intervals of three pixel rows and two pixel rows in a reverse direction.

The data driver 300 is connected to the plurality of data lines, samples and holds the image data signal ImD in response to a first driving control signal CONT1, and transmits a plurality data voltages data[1] to data[m] to the plurality of data lines, respectively. The data driver 300 is synchronized at a time when the voltage of each of the gate signals S[1] to S[n] become the gate-on voltage, and apply the plurality of data voltages data[1] to data[m], which is generated based on the image data signal ImD, to the plurality of data lines, respectively. The data driver 300 may sequentially apply a data voltage to pixels of a same color to the plurality of data lines when a gate signal is applied at intervals of three pixel rows.

Figure 2:
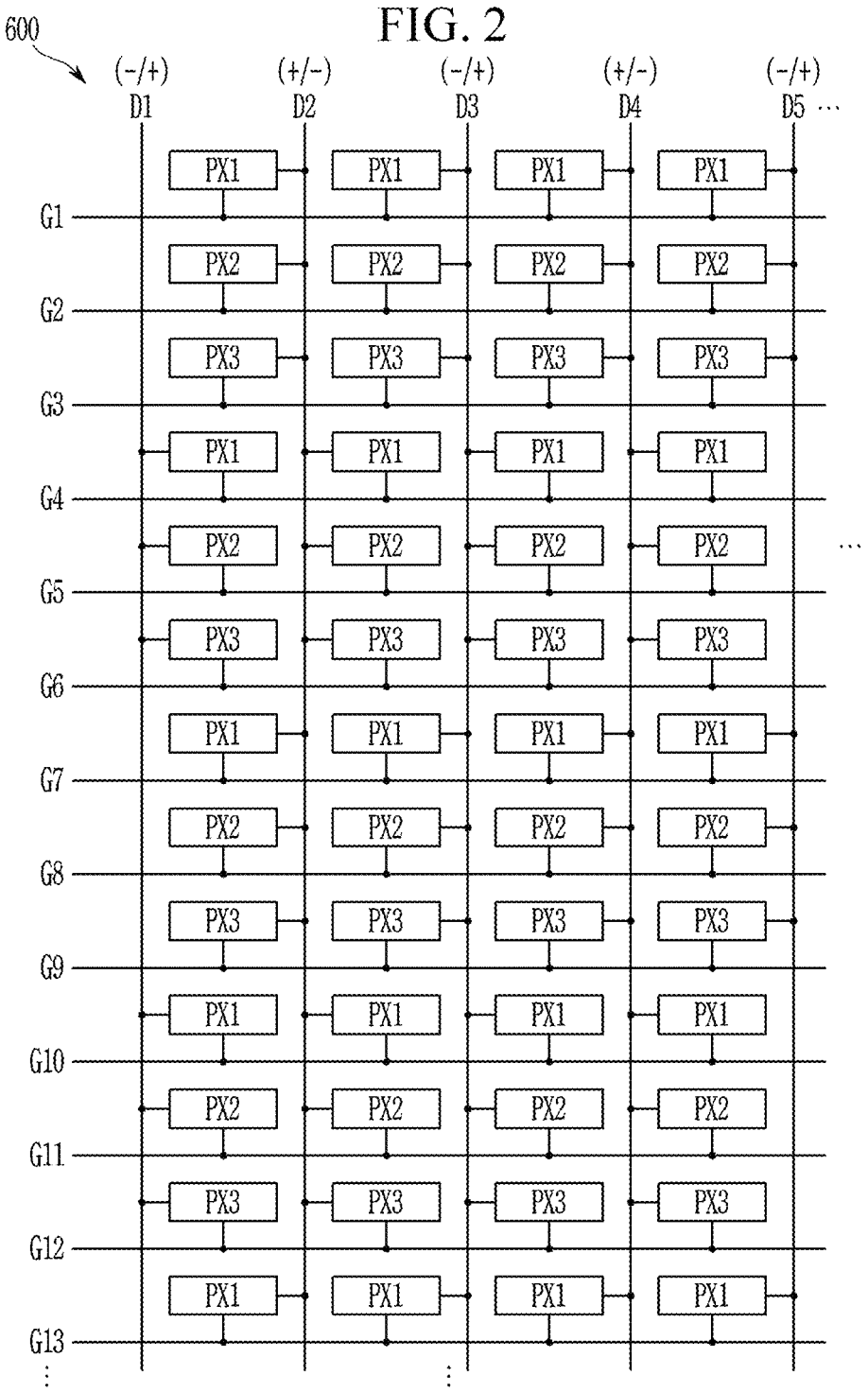
FIG. 2 shows a configuration of a display portion according to an exemplary embodiment of the invention.

FIG. 2 shows a configuration of a display portion according to an exemplary embodiment of the invention.

Referring to FIG. 2, in an exemplary embodiment, the display portion 600 may include a plurality of pixels PX1, PX2 and PX3, a plurality of gate line G1, G2, G3, G4, G5, G6, G7, G8, G9, G10, G11, G12, G13, . . . , and a plurality of data lines D1, D2, D3, D4, D5, . . . . The number of plurality of pixels PX1, PX2, and PX3, the number of the plurality of gate lines G1, G2, G3, G4, G5, G6, G7, G8, G9, G10, G11, G12, and G13, . . . , and the number of the plurality of data lines D1, D2, D3, D4, D5, . . . are not particularly limited.

The plurality of pixels PX1, PX2 and PX3 may include a plurality of first pixels PX1, a plurality of second pixels PX2, and a plurality of third pixels PX3. The first pixels PX1, the second pixels PX2 and third pixels PX3 may be pixels of different colors. In one exemplary embodiment, for example, the first pixel PX1 may be one of a red pixel, a green pixel and a blue pixel, the second pixel PX2 may be another of the red pixel, the green pixel and the blue pixel, and the third pixel PX3 may be the other of the red pixel, the green pixel and the blue pixel. In one exemplary embodiment, for example, the first pixel PX1 may be a blue pixel, the second pixel PX2 may be a green pixel, and the third pixel PX3 may be a red pixel. In one alternative exemplary embodiment, for example, the first pixel PX1 may be the red pixel, the second pixel PX2 may be the green pixel, and the third pixel may be the blue pixel. However, the first pixel PX1, the second pixel PX2, and the third pixel PX3 display a desired color to realize a color display by a temporal or spatial combination, and colors of the first pixel PX1, the second pixel PX2 and the third pixel PX3 are not particularly limited.

In an exemplary embodiment, the first pixels PX1, the second pixels PX2 and the third pixels PX3 in each of the plurality of pixel columns are alternately arranged in a column direction. In such an embodiment, a plurality of pixels included in a same pixel row represent a same color, and a plurality of pixels that are adjacent to each other at intervals of three pixel rows represent a same color. In such an embodiment, a plurality of pixels connected to a k-th gate line and a plurality of pixels connected to a (k+3)-th gate lines may display a first color, a plurality of pixels connected to a (k+1)-th gate line and a plurality of pixels connected to a (k+4)-th gate line may display a second color, and a plurality of pixels connected to a (k+2)-th gate line and a plurality of pixels connected to a (k+5)-th gate line may display a third color. Here, k is an integer greater than 1. The first color, the second color and the third color may be different from each other. In one exemplary embodiment, for example, the first color may be one of red, green and blue, the second color may be another one of red, green and blue, and the third color may be the other of red, green and blue.

In an exemplary embodiment, as shown in FIG. 2, the first pixel PX1, the second pixel PX2 and the third pixel PX3 in a first pixel column that is disposed between a first data line D1 and a second data line D2 are alternately arranged in a column direction. In such an embodiment, the first pixel PX1, the second pixel PX2 and the third pixel PX3 in a second pixel column that is disposed between the second data line D2 and the third data line D3 are alternately arranged in the column direction.

In an exemplary embodiment, a plurality of first pixels PX1 connected to a first gate line G1 is included in the first pixel row. A plurality of second pixels PX2 connected to a second gate line G2 is included in a second pixel row. A plurality of third pixels PX3 connected to a third gate line G3 is included in a third pixel row. A plurality of first pixels PX1 connected to a fourth gate line G4 is included in a fourth pixel row. A plurality of second pixels PX2 connected to a fifth gate line G5 is included in a fifth pixel row. A plurality of third pixels PX3 connected to a sixth gate line G6 is included in a sixth pixel row. In such an embodiment, pixels of a same color may be included in a same pixel row, pixels of the same color may be adjacent to each other at intervals of three pixel rows, and pixels of different colors may be adjacent to each other at intervals of one or two pixel rows.

The plurality of gate lines G1, G2, G3, G4, G5, G6, G7, G8, G9, G10, G11, G12, G13, . . . may extend in a row direction along pixel rows, respectively.

The plurality of data lines D1, D2, D3, D4, D5, . . . may extend in a column direction at opposite sides of each of the plurality of pixel columns.

In an exemplary embodiment, the data driver 300 may apply data voltages of different polarities to adjacent data lines at opposite sides of each of the plurality of pixel columns. In an exemplary embodiment, the data driver 300 may invert polarities of data voltages applied to the plurality of data lines D1, D2, D3, D4, D5, . . . every frame unit.

In one exemplary embodiment, for example, during one frame, a negative (−) data voltage may be applied to a first data line D1, a positive (+) data voltage may be applied to a second data line D2, a negative (−) data voltage may be applied to a third data line D3, a positive (+) data voltage may be applied to a fourth data line, and a negative (−) data voltage may be applied to a fifth data line D5. In such an embodiment, during a next frame, a positive (+) data voltage may be applied to the first data line D1, a negative (−) data voltage may be applied to the second data line D2, a positive (+) data voltage may be applied to the third data line D3, a negative (−) data voltage may be applied to the fourth data line D4, and a positive (+) data voltage may be applied to the fifth data line D5.

In such an embodiment, a connection direction between a plurality of pixels and data lines at opposite sides of each of the plurality of pixel columns may be changed at intervals of three pixel rows. In an exemplary embodiment, as shown in FIG. 2, pixels disposed in the first to third pixel rows in each of the pixel columns may be connected to a data line that is adjacent to a first side (i.e., the right side), pixels disposed in the fourth to sixth pixel rows may be connected to a data line that is adjacent to a second side (i.e., the left side), pixels disposed in the seventh to ninth pixel rows may be connected to a data line that is adjacent to the first side (i.e., the right side), and pixel disposed in the tenth to twelfth pixel row may be connected to a data line that is adjacent to the second side (i.e., the left side).

In such an embodiment having a connection structure of FIG. 2, a polarity of a data voltage applied to pixels in each pixel column may be changed at intervals of three pixel rows. In such an embodiment, in each of the plurality of pixel rows, a pixel may be charged with a data voltage having a polarity that is opposite to a polarity of a data voltage applied to adjacent lateral pixels.

In one exemplary embodiment, for example, when a negative (−) data voltage is applied to the first data line D1 and the third data line D3, a positive (+) data voltage may be applied to the second data line D2 such that a positive (+) data voltage may be applied to pixels of first to third pixel rows in a first pixel column, a negative (−) data voltage may be applied to pixels of fourth to sixth pixel rows in the first pixel column, a positive (+) data voltage may be applied to seventh to ninth pixel rows in the first pixel column, and a negative (−) data voltage may be applied to pixels of tenth to twelfth pixel rows in the first pixel column, and such that a negative (−) data voltage may be applied to pixels of first to third pixel rows in a second pixel column, a positive (+) data voltage may be applied to pixels of fourth to sixth pixel rows in the second pixel column, a negative (−) data voltage may be applied to pixels of seventh to ninth pixel rows in the second pixel column, and a positive (+) data voltage may be applied to pixels of tenth to twelfth pixel rows in the second pixel column.

Figure 3:
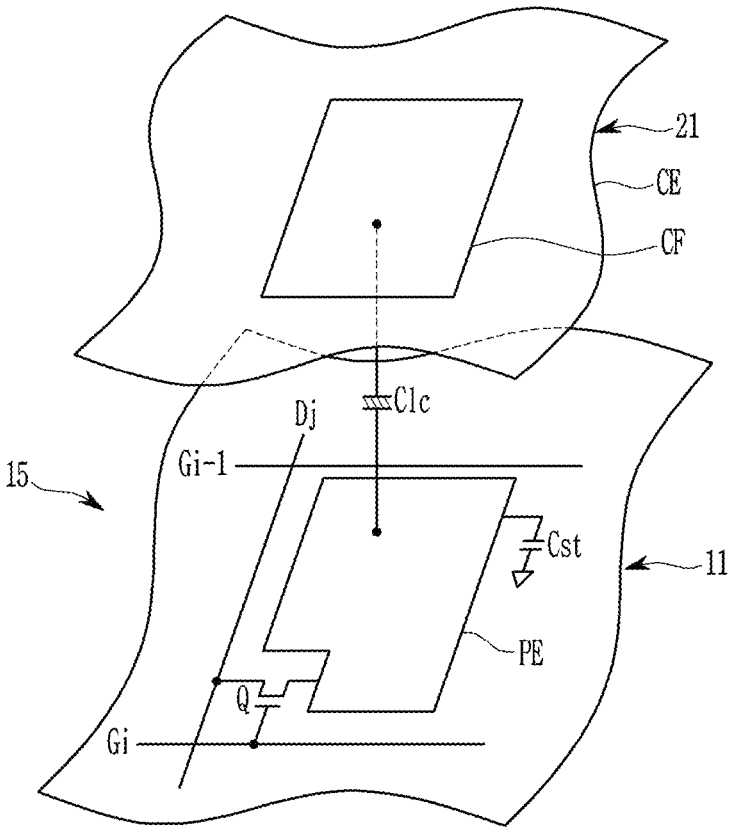
FIG. 3 shows a pixel according to an exemplary embodiment.

FIG. 3 shows a pixel according to an exemplary embodiment.

In FIG. 3, a pixel of the plurality of pixels included in the display portion 600 is illustrated. The pixel includes a switch Q, a liquid crystal capacitor Clc, and a storage capacitor Cst.

The switch Q may be a three-terminal element, such as a transistor or the like, disposed in a first display panel 11. The switch Q includes a gate terminal connected to a corresponding gate line, e.g., an i-th gate line Gi, a first terminal connected to a corresponding data line, e.g., a j-th data line Dj, and a second terminal connected to the liquid crystal capacitor Clc and the storage capacitor. Here, i and j are natural numbers.

The liquid crystal capacitor Clc includes a pixel electrode PE and a common electrode CE as two terminals thereof, and a liquid crystal layer 15 disposed between the pixel electrode PE and the common electrode CE is served as a dielectric material. The liquid crystal layer 15 has dielectric anisotropy. A pixel voltage is generated by a voltage difference between the pixel electrode PE and the common electrode CE.

The pixel electrode PE is connected to the switch Q and receives a data voltage. The common electrode CE receives a common voltage. The common voltage may be about zero (0) volt (V) or a predetermined voltage. Here, a polarity of a data voltage is defined with reference to the common voltage. Here, a data voltage that is higher than the common voltage may be a positive data voltage, and a data voltage that is lower than the common voltage may be a negative data voltage.

The common electrode CE may be disposed throughout a second display panel 21 that faces the first display panel 11. In an alternative exemplary embodiment, the common electrode CE may be disposed in the first display panel 11, and in such an embodiment, at least one of the pixel electrode PE and the common electrode CE may be in the shape of a line or a bar.

The storage capacitor Cst, which performs an auxiliary function of the liquid crystal capacitor Clc, may be formed by overlapping a separate signal line (not shown) provided in the first display panel 11 and the pixel electrode PE, while interposing an insulator therebetween.

A color filter CF may be disposed in the second display panel 21. Alternatively, the color filter CF may be disposed above or below the pixel electrode PE of the first display panel 11.

When a gate signal of a gate-on voltage is applied to the gate line Gi, a data voltage is applied to the data line Dj such that the data voltage is transmitted to the pixel electrode PE. Since the data voltage is charged to the pixel electrode PE, a pixel voltage may be defined by a voltage difference between the pixel electrode PE and the common electrode CE.

When a time for applying the gate signal of the gate-on voltage to the switch Q is shortened due to high-resolution of the display device, the data voltage may not be sufficiently charged to the pixel electrode PE. Accordingly, a color displayed by the pixel may be deteriorated, thereby causing an occurrence of color crosstalk or a charging-related stain. Particularly, such a color crosstalk or charging-related stain may become more significant when a certain area of an image is displayed with a primary color among red, green, and blue.

Hereinafter, referring to FIG. 4 to FIG. 6, a method for effectively preventing or substantially decreasing occurrence of color crosstalk or a charging-related stain will be described.

Figure 4:
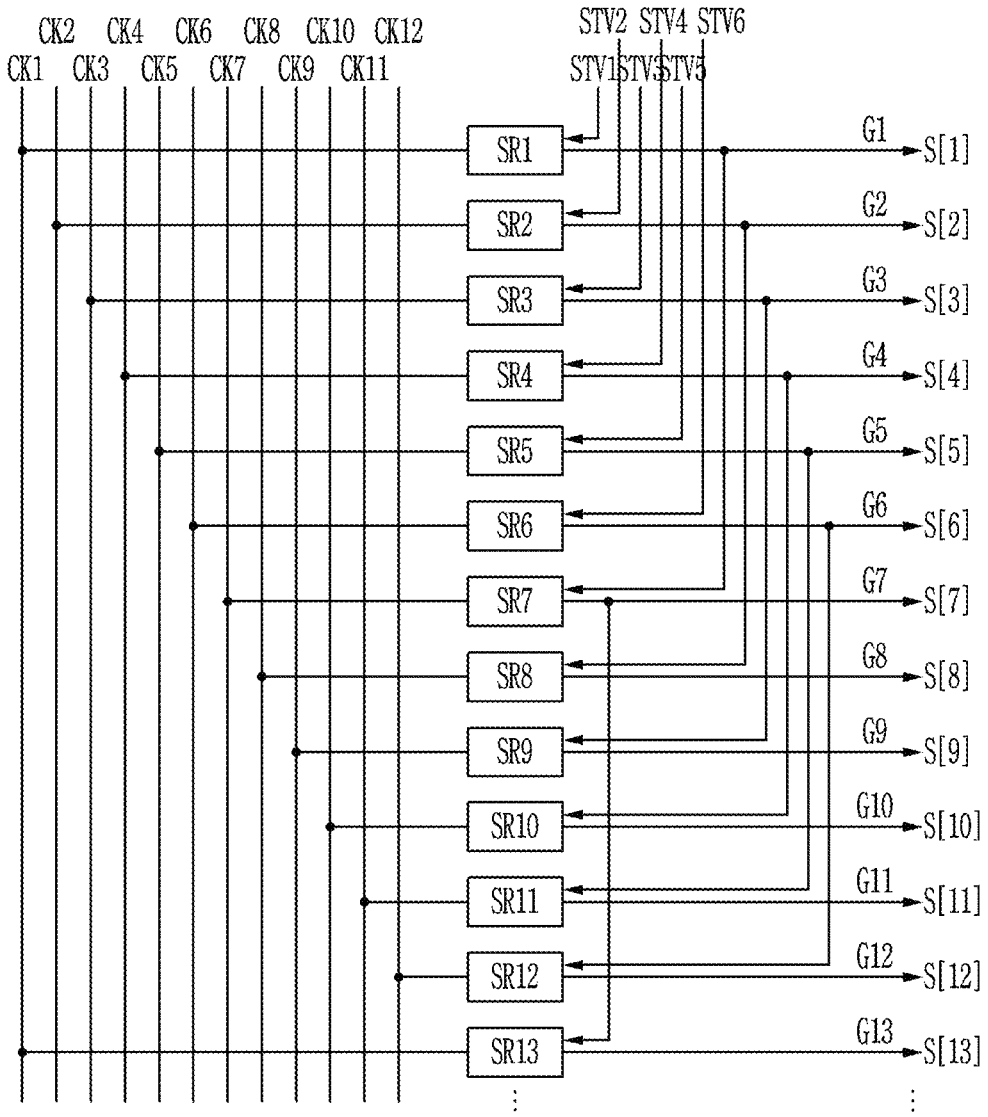
FIG. 4 shows a configuration of a gate driver according to an exemplary embodiment of the invention.

FIG. 4 shows a configuration of a data driver according to an exemplary embodiment of the invention. FIG. 5 and FIG. 6 are timing diagrams showing an exemplary embodiment of a driving method of the gate driver of FIG. 4.

In an exemplary embodiment, referring to FIG. 4, a gate driver 200 includes a plurality of driving blocks SR1, SR2, SR3, SR4, SR4, SR5, SR6, SR7, SR8, SR9, SR10, SR11, SR12, SR13, . . . connected to a plurality of gate lines G1, G2, G3, G4, G5, G6, G7, G8, G9, G10, G11, G12, G13, . . . , respectively The number of the gate driving blocks SR1, SR2, SR3, SR4, SR4, SR5, SR6, SR7, SR8, SR9, SR10, SR11, SR12, SR13, . . . may correspond to the number of the gate lines G1, G2, G3, G4, G5, G6, G7, G8, G9, G10, G11, G12, G13, . . . .

Each of the plurality of gate driving blocks SR1, SR2, SR3, SR4, SR4, SR5, SR6, SR7, SR8, SR9, SR10, SR11, SR12, SR13, . . . receives one of a plurality of gate start signals STV1 to STV6 or a gate signal of a previous gate driving block that is positioned 6 pixel rows ahead thereof. In such an embodiment, one of a plurality of clock signals CK1 to CK12 is input to each of the plurality of gate driving blocks SR1, SR2, SR3, SR4, SR4, SR5, SR6, SR7, SR8, SR9, SR10, SR11, SR12, SR13, . . . .

Each of the plurality of gate driving blocks SR1, SR2, SR3, SR4, SR4, SR5, SR6, SR7, SR8, SR9, SR10, SR11, SR12, SR13, . . . may output a gate signal of a gate-on voltage by being synchronized with one of the plurality of gate start signals STV1 to STV6 or a clock signal input after a gate signal of the previous gate driving block that is positioned 6 pixel rows ahead thereof.

In one exemplary embodiment, for example, the first gate driving block SR1 may receive a first gate start signal STV1 and a first clock signal CK1, and may apply a first gate signal S[1] of a gate-on voltage to a first gate line G1 by being synchronized with the first clock signal CK1.

In such an embodiment, the second gate driving block SR2 may receive a second gate start signal STV2 and a second clock signal CK2, and may apply a second gate signal S[2] of a gate-on voltage to a second gate line G2 by being synchronized with the second clock signal CK2.

In such an embodiment, the third gate driving block SR3 may receive a third gate start signal STV3 and a third clock signal CK3, and may apply a third gate signal S[3] of a gate-on voltage to a third gate line G3 by being synchronized with the third clock signal CK3.

In such an embodiment, the fourth gate driving block SR4 may receive a fourth gate start signal STV4 and a fourth clock signal CK4, and may apply a fourth gate signal S[4] of a gate-on voltage to a fourth gate line G4 by being synchronized with the fourth clock signal CK4.

In such an embodiment, the fifth gate driving block SR5 may receive a fifth gate start signal STV5 and a fifth clock signal CK5, and may apply a fifth gate signal S[5] of a gate-on voltage to a fifth gate line G5 by being synchronized with the fifth clock signal CK5.

In such an embodiment, the sixth gate driving block SR4 may receive a sixth gate start signal STV6 and a sixth clock signal CK6, and may apply a sixth gate signal S[6] of a gate-on voltage to a sixth gate line G6 by being synchronized with the sixth clock signal CK6.

In such an embodiment, the seventh gate driving block SR7 may receive a seventh gate start signal STV7 and a seventh clock signal CK7, and may apply a seventh gate signal S[7] of a gate-on voltage to a seventh gate line G7 by being synchronized with the seventh clock signal CK7.

In such an embodiment, the eighth gate driving block SR8 may receive an eighth gate start signal STV8 and an eighth clock signal CK8, and may apply an eighth gate signal S[8] of a gate-on voltage to an eighth gate line G8 by being synchronized with the eighth clock signal CK8.

In such an embodiment, the ninth gate driving block SR9 may receive a ninth gate start signal STV9 and a ninth clock signal CK9, and may apply a ninth gate signal S[9] of a gate-on voltage to a ninth gate line G9 by being synchronized with the ninth clock signal CK9.

In such an embodiment, the tenth gate driving block SR10 may receive a tenth gate start signal STV10 and a tenth clock signal CK10, and may apply a tenth gate signal S[10] of a gate-on voltage to a tenth gate line G10 by being synchronized with the tenth clock signal CK10.

In such an embodiment, the eleventh gate driving block SR11 may receive an eleventh gate start signal STV11 and an eleventh clock signal CK11, and may apply an eleventh gate signal S[11] of a gate-on voltage to an eleventh gate line G11 by being synchronized with the eleventh clock signal CK11.

In such an embodiment, the twelfth gate driving block SR12 may receive a twelfth gate start signal STV12 and a twelfth clock signal CK12, and may apply a twelfth gate signal S[12] of a gate-on voltage to a twelfth gate line G12 by being synchronized with the twelfth clock signal CK12.

In such an embodiment, the thirteenth gate driving block SR13 may receive a thirteenth gate start signal STV13 and a thirteenth clock signal CK13, and may apply a thirteenth gate signal S[13] of a gate-on voltage to a thirteenth gate line G13 by being synchronized with the thirteenth clock signal CK13.

In an exemplary embodiment, as described, the first to sixth gate driving blocks SR1 to SR6 respectively receive the first to sixth gate start signals STV1 to STV6, and subsequent driving blocks from the seventh driving block SR7 may receive a gate signal of a previous gate driving block that is positioned 6 pixel rows ahead thereof. In such an embodiment, the first to twelfth clock signals CK1 to CK12 are respectively applied to the first to twelfth gate driving blocks SR1 to SR12, and the first to twelfth clock signals CK1 to CK12 may be repeatedly applied to every subsequent 12 gate driving blocks from the thirteenth gate driving block SR13 as a unit.

In such an embodiment, where the gate driver 200 has the structure shown in FIG. 4, an application order of the plurality of gate signals S[1], S[2], S[3], S[4], S[5], S[6], S[7], S[8], S[9], S[10], S[11], S[12], S[13], . . . of the gate-on voltage output from the plurality of gate driving blocks SR1, SR2, SR3, SR4, SR4, SR5, SR6, SR7, SR8, SR9, SR10, SR11, SR12, SR13, . . . may be determined according to an application order of the plurality of gate start signals STV1 to STV6 and the plurality of clock signals CK1 to CK12.

Figure 5:
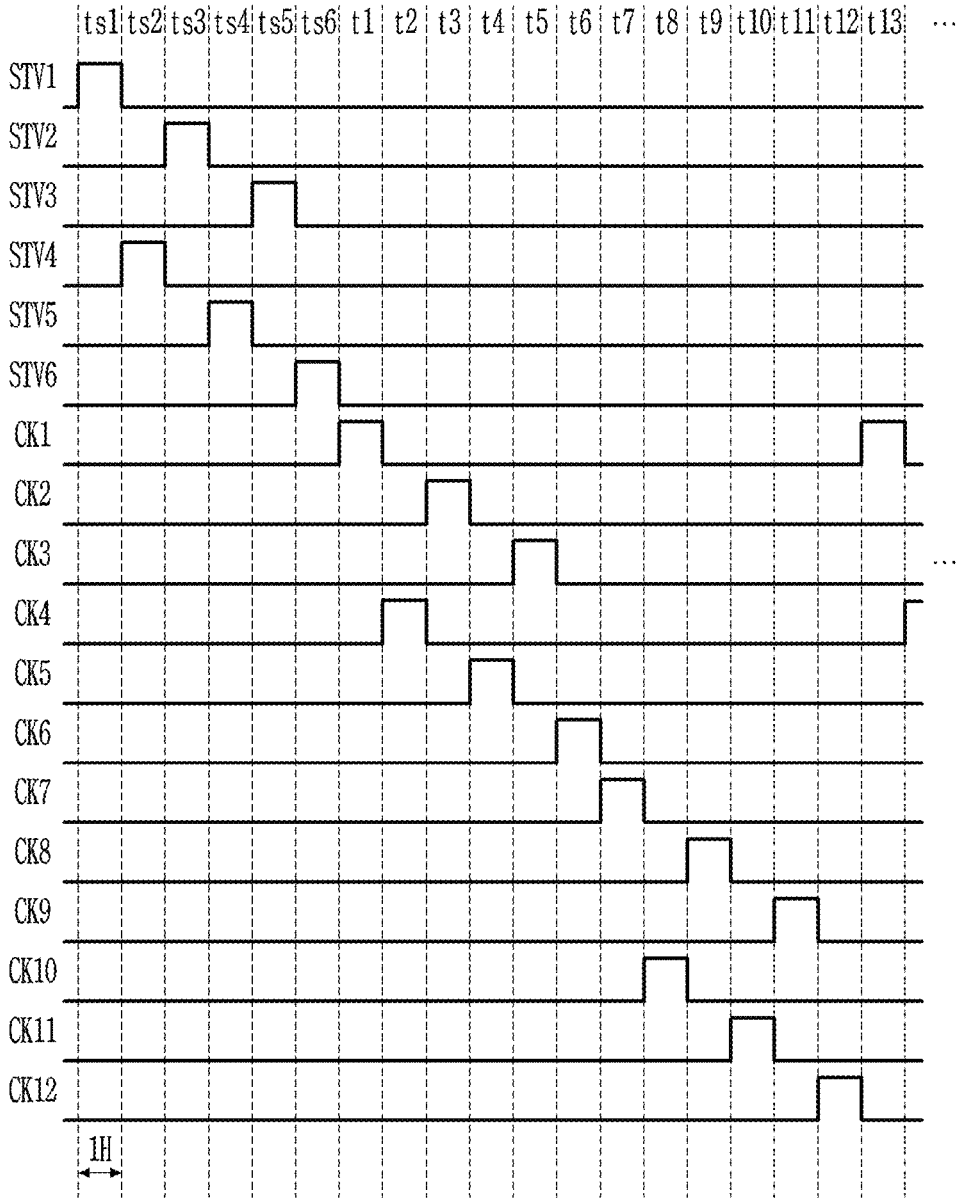
FIG. 5 and FIG. 6 are timing diagrams showing an exemplary embodiment of a driving method of the gate driver of FIG. 4.

In an exemplary embodiment, as shown in FIG. 5, the first to sixth gate start signals STV1 to STV6 are applied with the gate-on voltage in the order of the first gate start signal STV1, the fourth gate start signal STV4, the second gate start signal STV2, the fifth gate start signal STV5, the third gate start signal STV3, and the sixth gate start signal STV6 during first to sixth gate start periods ts1 to ts6.

Hereinafter, for convenience of description, the gate-on voltage will be described as a high level voltage, and a gate-off voltage will be described as a low level voltage. However, in some exemplary embodiments, the gate-on voltage may be a low level voltage and the gate-off voltage may be a high level voltage.

In an exemplary embodiment, each of the first to sixth gate start signals STV1 to STV6 may be applied as the gate-on voltage for one horizontal period 1H. One horizontal period 1H may be the same as one cycle of the horizontal synchronization signal Hsync. However, in an alternative exemplary embodiment, the first to sixth gate start signals STV1 to STV6 may be applied as a gate-on voltage for two or more horizontal periods from a time when the gate signal is applied as a gate-on signal, and in such an embodiment, some of the first to sixth gate start signals STV1 to STV6 may temporally overlap with each other. In one exemplary embodiment, for example, each of the first to sixth gate start signals STV1 to STV6 may be applied with the gate-on voltage for six horizontal periods from a time when the gate start signal is applied with the gate-on voltage.

In an exemplary embodiment, as shown in FIG. 5, the first to twelfth clock signals CK1 to CK12 may be applied as the gate-on voltage in the order of the first clock signal CK1, the fourth clock signal CK4, the second clock signal CK2, the fifth clock signal CK5, the third clock signal CK3, the sixth clock signal CK6, the seventh clock signal CK7, the tenth clock signal CK10, the eighth clock signal CK8, the eleventh clock signal CK11, the ninth clock signal CK9, and the twelfth clock signal CK12 during first to twelfth output periods t1 to t12. After a thirteenth output period t13, the first to twelfth clock signals CK1 to CK12 may be repeatedly applied with a same order during next twelve output periods, e.g., the thirteenth to twenty-fourth period, as in the first to twelfth output periods t1 to t12.

In an exemplary embodiment, as shown in FIG. 5, each of the first to twelfth clock signals CK1 to CK12 may be applied as a gate-on voltage during one horizontal period 1H. However, in an alternative exemplary embodiment, the first to twelfth clock signals CK1 to CK12 may be applied as a gate-on voltage for two or more horizontal periods from a time when the first to twelfth clock signals CK1 to CK12 are applied as the gate-on voltage, and in such an embodiment, some of the first to twelfth clock signals CK1 to CK12 may temporally overlap with each other. In one exemplary embodiment, for example, each of the first to twelfth clock signals CK1 to CK12 may be applied as a gate-on voltage for 6 horizontal periods from a time when the clock signal is applied as a gate-on voltage. In such an embodiment, seventh to twelfth clock signals CK7 to CK12 may be reverse signals of the first to sixth clock signals CK1 to CK6.

Figure 6:
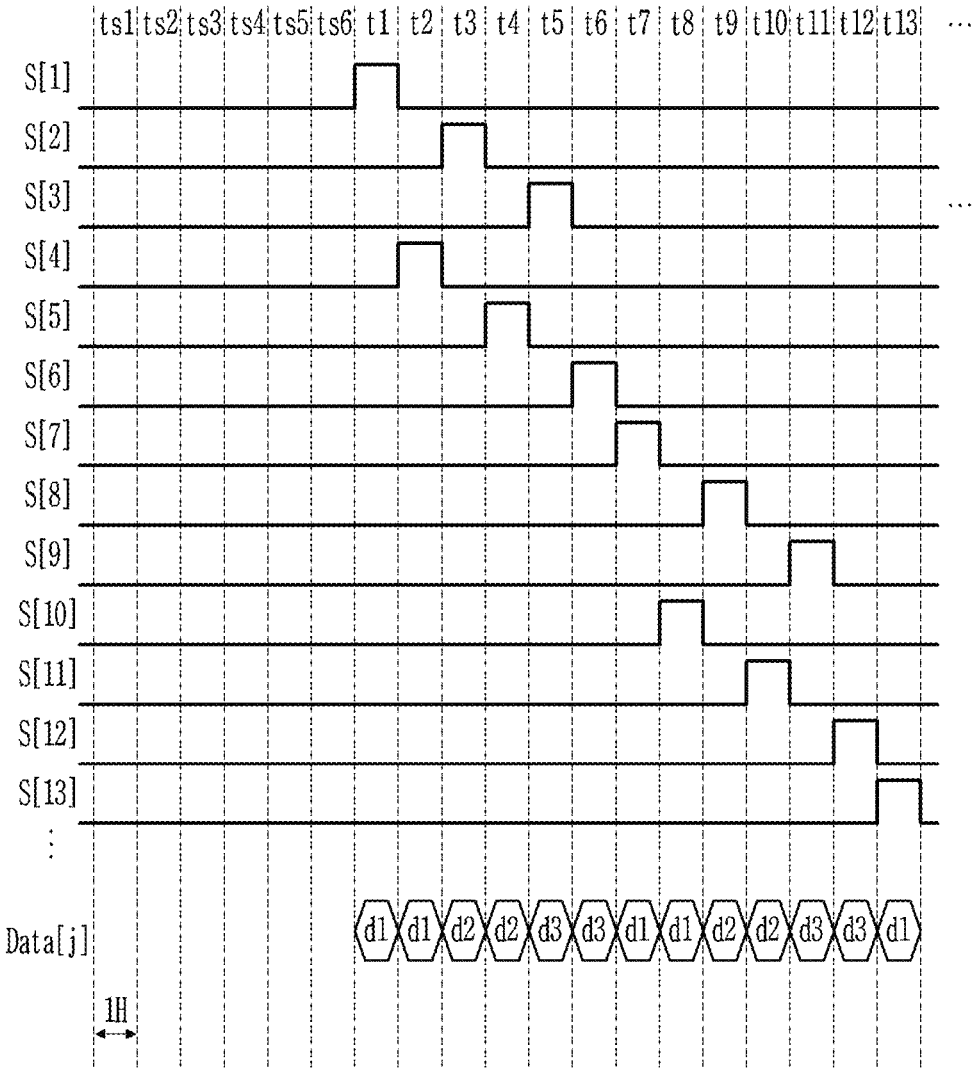

In an exemplary embodiment, when the plurality of gate start signals STV1 to STV6 and the plurality of clock signals CK1 to CK12 are applied as shown in FIG. 5, the plurality of gate driving blocks SR1, SR2, SR3, SR4, SR4, SR5, SR6, SR7, SR8, SR9, SR10, SR11, SR12, SR13, . . . are synchronized by the plurality of clock signals CK1 to CK12, and thus output the first to twelfth gate signals S[1] to S[12] in the order of the first gate signal S[1], the fourth gate signal S[4], the second gate signal S[2], the fifth gate signal S[5], the third gate signal S[3], the sixth gate signal S[6], the seventh gate signal S[7], the tenth gate signal S[10], the eighth gate signal S[8], the eleventh gate signal S[11], the ninth gate signal S[9] and the twelfth gate signal S[12], during the first to twelfth output periods t1 to t12, as shown in FIG. 6. After the thirteenth output period t13, the plurality of gate signals are output with the same order as in the first to twelfth output periods t1 to t12. In such an embodiment, after the first gate signal S[1] is output to the first gate line G1 for the first output period t1, the fourth gate signal S[4]

is output to the fourth gate line G4 that is adjacent to the first gate line G1 at intervals of three pixel rows in a forward direction, and after the fourth gate signal S[4] is output, the second gate signal S[2] is output to the second gate line G2 that is adjacent at an interval of two pixel rows in a reverse direction for the third output period t3. In such an embodiment, the gate signals of the gate-on voltage are output at intervals of a unit of 6 pixel rows from the first gate line G1 to the sixth gate line G6. The gate signals of the gate-on voltage may be output to the next gate lines at intervals of a unit of 6 pixel rows with the same manner as described above.

In such an embodiment, the gate signals of the gate-on voltage are applied in the order of a k-th gate line, a (k+3)-th gate line, a (k+2)-th gate line, and a (k+5)-th gate line (where k is an integer greater than 1). In such an embodiment, after the gate signal is applied to the (k+5)-th gate line, gate signals are applied in the order of a (k+6)-th gate line, a (k+9)-th gate line, a (k+7)-th gate line, a (k+10)-th gate line, a (k+8)-th gate line, and a (k+11)-th gate line.

In an exemplary embodiment, as described above, for every six pixel rows, the gate signals of the gate-on voltage are alternately output at intervals of three pixel rows in the forward direction and two pixel rows in the reverse direction. The forward direction is a direction from a gate driving block positioned ahead to a gate driving block positioned next, and the reverse direction is a direction from a gate driving block positioned next to a gate driving block positioned ahead. Herein, the phrase, "a unit of 6 pixel rows" may imply intervals of 6 pixel rows such as first to sixth pixel rows, seventh to twelfth pixel rows, thirteenth to eighteenth pixel rows and the like, or intervals of 6 gate lines such as first to sixth gate lines, seventh to twelfth gate lines, thirteenth to eighteen gate lines and the like.

In an exemplary embodiment, as described above, the gate driver 200 may sequentially output the gate signal of the gate-on voltage alternately at intervals of three pixel rows in the forward direction and two pixel rows in the reverse direction for every 6 pixel rows.

In such an embodiment, the data driver 300 outputs a data voltage Data[j] to a data line corresponding to a gate signal of a gate-on voltage. In an exemplary embodiment, as shown in FIG. 2 and FIG. 6, first pixels PX1 of the first pixel row and first pixels PX1 of the fourth pixel row are pixels of a same color, and therefore the data driver 300 may continuously apply a first data voltage d1 with respect to the first pixels PX1 of the same color to data lines for the first output period t1 and the second output period t2. In such an embodiment, second pixels PX2 of the second pixel row and second pixels PX2 of the fifth pixel row are pixels of a same color, and therefore the data driver 300 may continuously apply a second data voltage d2 with respect to the second pixels PX2 of the same color to data lines for the third output period t3 and the fourth output period t4. In such an embodiment, third pixels PX3 of the third pixel row and third pixels PX3 of the sixth pixel row are pixels of a same color, and therefore the data driver 300 may continuously apply a third data voltage d3 with respect to the third pixels PX3 of the same color to data lines for the fifth output period t5 and the sixth output period t6. In such an embodiment, the first data voltage d1 may be continuously applied to data lines for the seventh output period t7 and the eighth output period t8, the second data voltage d2 may be continuously applied to data lines for the ninth output period t9 and the tenth output period t10, and the third data voltage d3 may be continuously applied to data lines for the eleventh output period t11 and the twelfth output period t12.

In such an embodiment, when the gate signal of the gate-on voltage is applied at intervals of three pixel rows in the forward direction, the data driver 300 may continuously apply a data voltage with respect to pixels of a same color for two horizontal periods.

In such an embodiment, when a gate signal is applied to a k-th gate line and a (k+3)-th gate line, the data driver 300 may continuously apply a data voltage with respect to pixels of a first color to a plurality of data lines, when a gate signal is applied to a (k+1)-th gate line and a (k+4)-th gate line, the data driver 300 may continuously apply a data voltage with respect to pixels of a second color to the plurality of data lines, and when a gate signal is applied to a (k+2)-th gate line and a (k+5)-th gate line, the data driver 300 may continuously apply a data voltage with respect to pixels of a third color to the plurality of data lines.

When the plurality of gate signals S[1], S[2], S[3], S[4], S[5], S[6], S[7], S[8], S[9], S[10], S[11], S[12], S[13], . . . are sequentially output, the first data voltage d1, the second data voltage d2, and the third data voltage d3 should be alternately applied to the data lines for one horizontal period. If some of the image is displayed with a color of the second pixel PX2, a data voltage of about zero (0) V that corresponds to a common voltage is applied to the first pixel PX1 and a data voltage corresponding to the maximum luminance is desired to be applied to the next second pixel PX2, but the one horizontal period may be shortened due to high-resolution and high-speed of the display device, so the data voltage applied to the data line may not be sufficiently increased so that the data voltage may not be sufficiently charged to the second pixel PX2.

In an exemplary embodiment, a data voltage with respect to pixels of the same color may be continuously applied to data lines for two horizontal periods, and therefore a data voltage of the next second pixel PX2 may be sufficiently charged even through the data voltage is not sufficiently charged to the second pixel PX2 next to the first pixel PX1. Accordingly, occurrence of color crosstalk or charging-related stain due to insufficient charging of data voltage to pixels may be effectively prevented.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, it will be appreciated by those skilled in the art that various modifications may be made and other equivalent embodiments are available. Therefore, a true technical scope of the invention will be defined by the technical spirit of the appending claims.

What is claimed is:

1. A display device comprising:

a display portion including a plurality of pixels;

a plurality of gate lines extending in a row direction for each pixel row and connected to the plurality of pixels; and a gate driver which applies a gate signal having a gate-on voltage to the plurality of gate lines, wherein the gate driver applies the gate signal in the order of a $k^{th}$ gate line, a $(k+3)^{th}$ gate line, a $(k+1)^{th}$ gate line, a $(k+4)^{th}$ gate line, a $(k+2)^{th}$ gate line and a $(k+5)^{th}$ gate line during six consecutive horizontal periods, wherein k is equal to 6n+1, and n is an integer equal to or greater than zero, a plurality of pixels connected to the $k^{th}$ gate line and a plurality of pixels connected to the $(k+3)^{th}$ gate line display a first color, a plurality of pixels connected to the $(k+1)^{th}$ gate line and a plurality pixels connected to the $(k+4)^{th}$ gate line display a second color, and a plurality of pixels connected to the $(k+2)^{th}$ gate line and a plurality of pixels connected to the $(k+5)^{th}$ gate line display a third color.

2. The display device of claim 1, wherein a plurality of pixels in a same pixel row, among the plurality of pixels, display a same color as each other.

3. The display device of claim 2, wherein the first color, the second color and the third color are different colors from each other.

4. The display device of claim 1, wherein the gate driver applies the gate signal in the order of a $(k+6)^{th}$ gate line, a $(k+9)^{th}$ gate line, a $(k+7)^{th}$ gate line, a $(k+10)^{th}$ gate line, a $(k+8)^{th}$ gate line, and a $(k+11)^{th}$ gate line after applying the gate signal to the $(k+5)^{th}$ gate line.

5. The display device of claim 4, further comprising:

a plurality of data lines connected to the plurality of pixels; and a data driver which applies a plurality of data voltages to the plurality of data lines, wherein the data driver applies data voltages of different polarities to data lines at opposite sides of each of a plurality of pixel columns.

6. The display device of claim 5, wherein a connection direction between a plurality of pixels in each of the plurality of pixel columns and the data lines at the opposite sides thereof is changed every three pixel rows.

7. The display device of claim 6, wherein a polarity of a data voltage applied to the plurality of pixels of each of the plurality of pixel columns is changed every three pixel rows.

8. The display device of claim 5, wherein the data driver continuously applies a data voltage for the pixels of the first color to the plurality of data lines when the gate signal having the gate-on voltage is applied to the $k^{th}$ gate line and the $(k+3)^{th}$ gate line, the data driver continuously applies a data voltage for the pixels of the second color to the plurality of data lines when the gate signal having the gate-on voltage is applied to the $(k+1)^{th}$ gate line and the $(k+4)^{th}$ gate line, and the data driver continuously applies a data voltage for the pixels of the third color to the plurality of data lines when the gate signal having the gate-on voltage is applied to the $(k+2)^{th}$ gate line and the $(k+5)^{th}$ gate line.

9. A display device comprising:

a plurality of gate lines connected to a plurality of pixels; and a gate driver which applies a plurality of gate signals to the plurality of gate lines by being synchronized by a plurality of clock signals, wherein the gate driver comprises:

a first gate driving block which outputs a first gate signal to a first gate line by being synchronized with a first clock signal;

a second gate driving block which outputs a second gate signal to a second gate line, which is adjacent to the first gate line, by being synchronized with a second clock signal;

a third gate driving block which outputs a third gate signal to a third gate line, which is adjacent to the second gate line, by being synchronized with a third clock signal;

a fourth gate driving block which outputs a fourth gate signal to a fourth gate line, which is adjacent to the third gate line, by being synchronized with a fourth clock signal;

a fifth gate driving block which outputs a fifth gate signal to a fifth gate line, which is adjacent to the fourth gate line, by being synchronized with a fifth clock signal; and a sixth gate driving block which outputs a sixth gate signal to a sixth gate line, which is adjacent to the fifth gate line, by being synchronized with a sixth clock signal, and wherein the plurality of clock signals having a gate-on voltage is applied to the gate driver in the order of the first clock signal, the fourth clock signal, the second clock signal, the fifth clock signal, the third clock signal and the sixth clock during six consecutive horizontal periods.

10. The display device of claim 9, wherein the gate driver outputs the plurality of gate signals having a gate-on voltage in the order of the first gate signal, the fourth gate signal, the second gate signal, the fifth gate signal, the third gate signal, and the sixth gate signal.

11. The display device of claim 9, further comprising:

a plurality of first pixels connected to one of the first gate line and the fourth gate line;

a plurality of second pixels connected to one of the second gate line and the fifth gate line; and a plurality of third pixels connected to one of the third gate line and the sixth gate line, wherein the first pixels, the second pixels and the third pixels display different colors from each other.

12. The display device of claim 11, wherein each of the first pixels is one of a red pixel, a green pixel and a blue pixel, each of the second pixels is another of the red pixel, the green pixel and the blue pixel, and each of the third pixels is the other of the red pixel, the green pixel and the blue pixel.

13. The display device of claim 11, further comprising:

a plurality of data lines connected to the plurality of pixels; and a data driver which applies a plurality of data voltages to the plurality of data lines, wherein the data driver continuously applies a data voltage for the first pixels to the plurality of data lines when the first gate signal and the fourth gate signal have the gate-on voltage.

14. The display device of claim 13, wherein the data driver continuously applies a data voltage for the second pixels to the plurality of data lines when the second gate signal and the fifth gate signal have the gate-on voltage.

15. The display device of claim 13, wherein the data driver continuously applies a data voltage for the third pixels to the plurality of data lines when the third gate signal and the sixth gate signal have the gate-on voltage.

16. A driving method of a display device including a plurality of gate lines and a plurality of data lines, the gate lines extending in a row direction and connected to a plurality of pixels, the plurality of data lines connected to the plurality of pixels, the method comprising:

applying a gate signal having a gate-on voltage to the gate lines in the order of a $k^{th}$ gate line, a $(k+3)^{th}$ gate line, a $(k+1)^{th}$ gate line, a $(k+4)^{th}$ gate line, a $(k+2)^{th}$ gate line, and a $(k+5)^{th}$ gate line during six consecutive horizontal periods, wherein k is equal to 6n+1, and n is an integer equal to or greater than zero; and applying a data voltage corresponding to the gate signal to the plurality of data lines, wherein a plurality of pixels connected to the $k^{th}$ gate line and a plurality of pixels connected to the $(k+3)^{th}$ gate line display a first color, a plurality of pixels connected to the $(k+1)^{th}$ gate line and a plurality of pixels connected to the $(k+4)^{th}$ gate line display a second color, and a plurality of pixels connected to the $(k+2)^{th}$ gate line and a plurality of pixels connected to the $(k+5)^{th}$ gate line display a third color.

17. The driving method of the display device of claim 16, wherein the pixels included in a same pixel row, among the plurality of pixels, display a same color as each other.

18. The driving method of the display device of claim 17, wherein the first color, the second color and the third color are different colors from each other.

19. The driving method of the display device of claim 16, further comprising:

applying the gate signal to the gate lines in the order of a $(k+6)^{th}$ gate line, a $(k+9)^{th}$ gate line, a $(k+7)^{th}$ gate line, a $(k+10)^{th}$ gate line, a $(k+8)^{th}$ gate line, and a $(k+11)^{th}$ gate line after the applying the gate signal to the $(k+5)^{th}$ gate line.

20. The driving method of the display device of claim 19, wherein the applying the data voltage corresponding to the gate signal to the plurality of data lines comprises:

continuously applying a data voltage for the pixels of the first color to the plurality of data lines when the gate signal is applied to the $k^{th}$ gate line and the $(k+3)^{th}$ gate line;

continuously applying a data voltage for the pixels of the second color to the plurality of data lines when the gate signal is applied to the $(k+1)^{th}$ gate line and the $(k+4)^{th}$ gate line; and continuously applying a data voltage for the pixels of the third color to the plurality of data lines when the gate signal is applied to the $(k+2)^{th}$ gate line and the $(k+5)^{th}$ gate line.

* * * * *